US008912904B2

(12) United States Patent
Ho

(10) Patent No.: US 8,912,904 B2
(45) Date of Patent: Dec. 16, 2014

(54) SECURITY TAG HAVING MAGNETICALLY RELEASABLE LATCH

(71) Applicant: Sensormatic Electronics, LLC, Boca Raton, FL (US)

(72) Inventor: Wing Kei Ho, Boynton Beach, FL (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 121 days.

(21) Appl. No.: 13/693,290

(22) Filed: Dec. 4, 2012

(65) Prior Publication Data

US 2013/0141242 A1 Jun. 6, 2013

Related U.S. Application Data

(60) Provisional application No. 61/630,271, filed on Dec. 6, 2011.

(51) Int. Cl.
*G08B 13/14* (2006.01)
*E05B 73/00* (2006.01)
*G08B 13/24* (2006.01)

(52) U.S. Cl.
CPC ..... *E05B 73/0017* (2013.01); *G08B 13/2434* (2013.01)
USPC ..... 340/572.1; 340/572.8; 340/572.9; 24/704.1; 70/57.1

(58) Field of Classification Search
CPC ..... G08B 13/2434; G08B 13/2448; G08B 13/1502; E05B 73/0017; E05B 73/0052; E05B 2015/0472
USPC ..... 340/572.1–572.9, 568.1, 551; 24/704.1, 24/707.5, 110, 114.4; 70/57.1, 391, 416, 70/453
See application file for complete search history.

(56) References Cited

U.S. PATENT DOCUMENTS

| | | | | |
|---|---|---|---|---|
| 4,502,717 | A * | 3/1985 | Close | 70/57.1 |
| 5,600,977 | A | 2/1997 | Piron | |
| 6,920,769 | B2 * | 7/2005 | Huehner | 70/57.1 |
| 7,724,146 | B2 | 5/2010 | Nguyen et al. | |
| 2009/0021378 | A1 * | 1/2009 | Lynch et al. | 340/572.1 |
| 2010/0097223 | A1 * | 4/2010 | Kruest et al. | 340/572.1 |

FOREIGN PATENT DOCUMENTS

| | | | |
|---|---|---|---|
| WO | WO2006/055774 | A1 | 5/2006 |
| WO | WO2008/027289 | A2 | 3/2008 |
| WO | WO2012/177621 | A1 | 12/2012 |

OTHER PUBLICATIONS

EPO International Search Report dated May 14, 2013 for corresponding appln PCT/US12/067751.

* cited by examiner

*Primary Examiner* — Anh V La
(74) *Attorney, Agent, or Firm* — Alan M. Weisberg; Christopher & Weisberg, P.A.

(57) ABSTRACT

A security system including a security tag is provided. The security tag includes a housing and a pin in which the pin is removably insertable into the housing. The security tag further includes a latching element disposed within the housing and positionable in a lock position and in an unlock position. The latching element includes a pivot axis. The latching element has a substantially balanced rotational response about the pivot axis when exposed to an external physical mechanical impulse. The security tag further includes a bias element that releasably positions the latching element in the lock position. The latching element releasably engages the inserted pin when in the lock position.

21 Claims, 9 Drawing Sheets

SECURITY TAG HAVING MAGNETICALLY RELEASABLE LATCH

STATEMENT REGARDING FEDERALLY SPONSORED RESEARCH OR DEVELOPMENT n/a

FIELD OF THE INVENTION

The present invention relates to security tags, and in particular to security tags having magnetically releasable locks.

BACKGROUND OF THE INVENTION

Electronic article surveillance (EAS) systems are rapidly becoming common place in a vast majority of businesses where removal of items needs to be monitored. Typical EAS systems include an EAS monitoring system and one or more security tags attached to various items that are detected when in range of the EAS monitoring system. For example, the EAS monitoring system creates a surveillance zone at an access point for a controlled or monitored area. When a security tag attached to an item enters the surveillance zone, an alarm is triggered indicating the unauthorized removal of the item from the controlled area.

Several security tag attachment mechanisms have been implemented for attaching a security tag to an item. For example, as illustrated in FIG. 1, tag 10 includes a magnetic locking mechanism that engages tack 12. Wedge element 14 has a length 1 and rotational axis 16 located at the fixed end of wedge element 14. The end opposite the fixed end of wedge element 14 engages tack 12 when tack 12 is inserted in tag 10 due in part to the force applied by rubber spring 18. In particular, rubber spring 18 provides a bias force to position wedge element 14 in a lock position such that one end of wedge element 14 engages tack 12.

To remove the tag 10 from the item, a magnetic field is applied to wedge element 14 that causes a magneto-mechanical response from the wedge element 14, i.e., wedge element 14 is pulled down towards magnet. The resulting magneto-mechanical response of wedge element 14 exceeds the bias force, thereby re-positioning wedge element 14 to the unlock position by compressing rubber spring 18, i.e., wedge element disengages tack 12. A perspective view of wedge element 14 is illustrated in FIG. 2 in which mounting tabs 20 are located at the pivot or fixed end of wedge element 14 such that wedge element 14 pivots about rotational axis 16 that passes through mounting tabs 20.

While the elongated configuration of wedge element 14 and rotational axis 16 positioned at one end of wedge element 14 help maximize the magneto-mechanical response of wedge element 14, the elongated configuration is susceptible to external mechanical forces. For example, a rotational force similar to that of the magneto-mechanical response of wedge element 14 can be accomplished by mechanical means in which the effective length of the moment arm of wedge element 14 causes wedge element 14 to impart a rotational force on rubber spring 18 sufficient to dislodge wedge element 14 from tack 12. In other words, a thief can deliver a well-placed external blow to security tag 10 to cause wedge element 14 to compress rubber spring 18, thereby temporarily moving wedge element 14 to the unlock position such that tack 12 can be removed.

In order to reduce the susceptibility of magnetic locks to external mechanical forces or impulses, i.e., a thief banging the tag on a surface, several approaches have been proposed.

Once approach involves using a spring with a greater spring force, i.e., stiffer spring, in order to counteract the external mechanical forces. However, a stiffer spring results in a magnetic lock that requires a stronger and typically more expensive magnet to overcome the greater spring force of the spring, which may also result in an EAS tag that is harder to detach.

Another proposed approach is to use a security tag with multiple wedging elements that are actuated by multiple magnets in which each magnet corresponds to a respective wedging element. In other words, each wedging element must be in matching arrangement with each of the magnets such that each wedging element unfastens from the inserted tack. In order for a thief to remove the tag, the thief would have to simultaneously apply a mechanical force to each wedging element in specific directions to get each wedging element to move in a particular direction away from the pin/tack. While this approach reduces the susceptibility of the magnetic lock to external forces, the use of multiple wedging elements requires more precise placement of the tag on the detaching magnet arrangement that may create additional complexity and cost.

SUMMARY OF THE INVENTION

The present invention advantageously provides a system, device and method for an improved security tag locking mechanism.

According to one embodiment, a security tag is provided. The security tag includes a housing and a latching element disposed within the housing and positionable in a lock position and in an unlock position. The latching element includes a pivot axis. The latching element has a substantially balanced rotational response about the pivot axis when exposed to an external physical mechanical impulse. The security tag further includes a bias element that releasably positions the latching element in the lock position.

According to another embodiment, a security system including a security tag is provided. The security tag includes a housing and a pin in which the pin is removably insertable into the housing. The security tag further includes a latching element disposed within the housing and positionable in a lock position and in an unlock position. The latching element includes a pivot axis. The latching element has a substantially balanced rotational response about the pivot axis when exposed to an external physical mechanical impulse. The security tag further includes a bias element that releasably positions the latching element in the lock position. The latching element releasably engages the inserted pin when in the lock position.

According to another embodiment, a latching element for use in a security tag is provided. The latching element includes a center of gravity and a pivot axis. The pivot axis is disposed substantially near the center of gravity. The plurality of pivot tabs are disposed along the axis and rotatable about the pivot axis.

According to another embodiment, a security system including a security tag is provided. The security tag device includes a housing and a pin in which the pin is removably insertable into the housing. A first latching element is disposed within the housing and positionable in a first lock position and in a first unlock position. The security tag further includes a first bias element in which the first bias element releasably positions the first latching element in the first lock position. The first latching element releasably engages the inserted pin when in the first lock position. The security tag further includes a second latching element disposed within the housing and positionable in a second lock position and in a second unlock position. The security tag further includes a second bias element in which the second bias element releasably positioning the second latching element in the second lock position. The second latching element releasably engages the inserted pin when in the second lock position.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
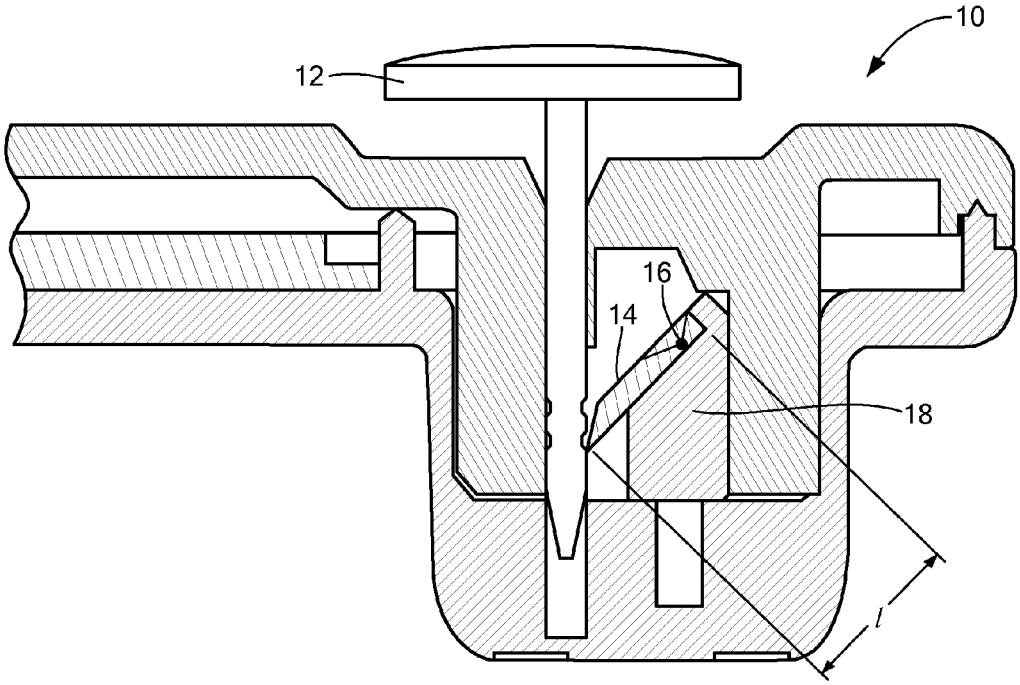
FIG. 1 PRIOR ART
FIG. 1 is a cross-sectional view of a portion of a known security tag.
Figure 2:
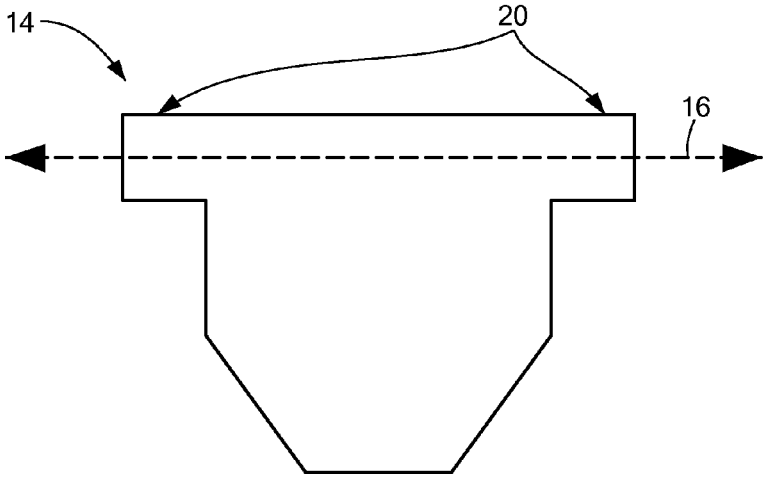
FIG. 2 PRIOR ART
FIG. 2 is a perspective view of the wedge element of FIG. 1.

The present invention advantageously provides a system, device and method for removable security tags. Accordingly, the system, device and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

Figure 3:
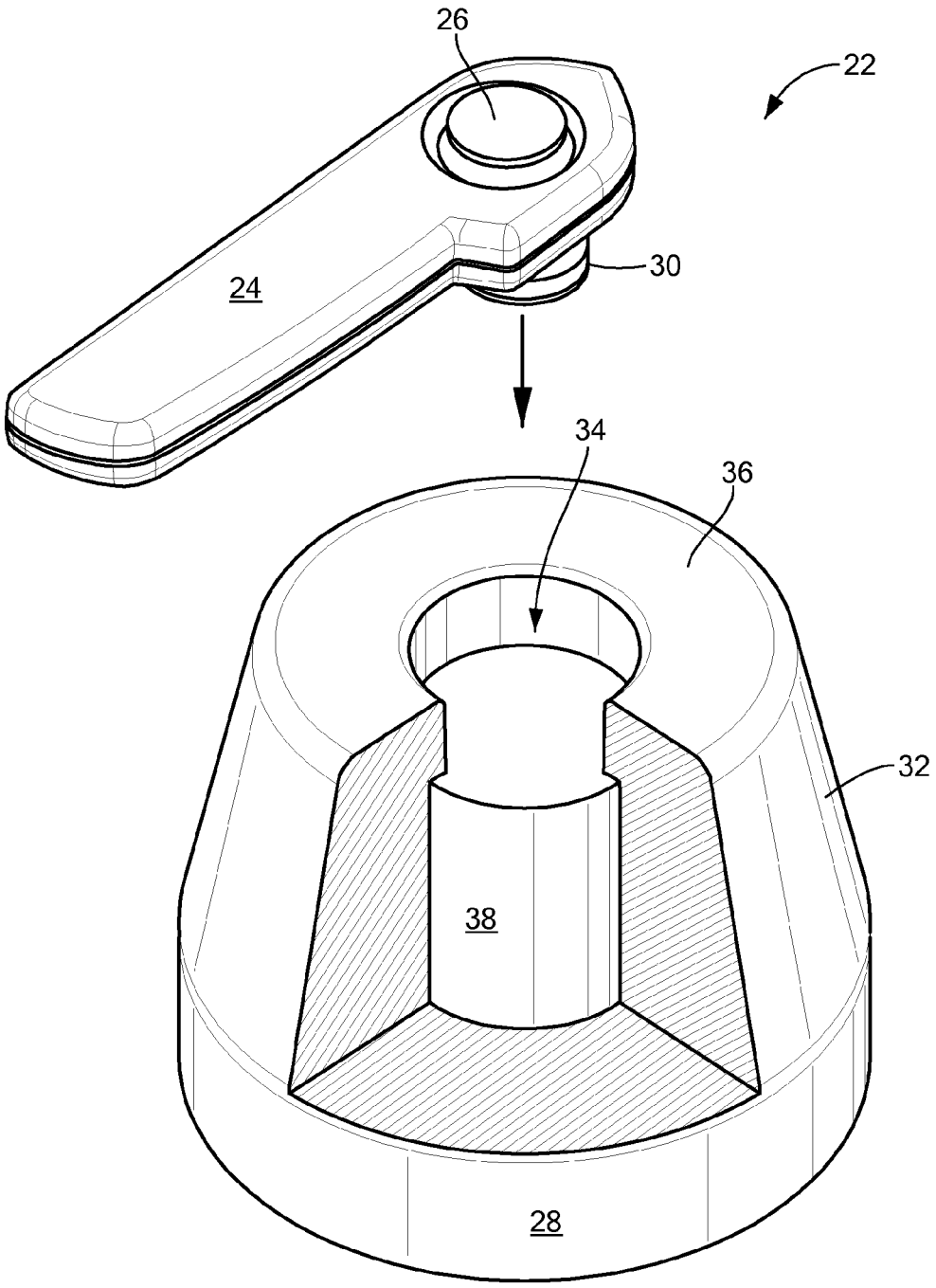
FIG. 3 illustrates a perspective view of a security tag system constructed in accordance with the present invention.

Referring now to the drawing figures in which like reference designators refer to like elements there is shown in FIG. 3 a perspective view of an exemplary security tag system constructed in accordance with the principles of the present invention and designated generally as "22." System 22 includes security tag 24, tack 26 and detacher 28. Security tag 24 may includes protrusion 30 that is shaped to be received by receiving aperture 34 of detacher 28. Protrusion 30 helps align security tag 24 with detacher 28 to facilitate tack 26 removal. Other tag protrusions and/or indentations configurations for security tag 24 alignment with detacher 28 may be implemented based on design need.

Security tag 24 may be made out of semi-hard and/or rigid material such as injection molded Acrylonitrate-Butadience-Styrene (ABS) plastic or polycarbonate constructed using various materials such as metal and/or plastic. While security tag 24 is illustrated having an elongated shape, other tag shapes may be used based on design need. For example, other security tag 24 shapes may be implemented based at least in part on detacher 28 configuration.

Detacher 28 includes detacher housing 32, receiving aperture 34 and magnetic element 38, among other components. Receiving aperture 34 is surrounded by bezel 36 in which receiving aperture 34 receives at least a portion of security tag 24, i.e., tag protrusion 30. Receiving aperture 34 helps ensure proper tag alignment with magnetic element 38. Magnetic element 38 such as a magnet or multiple magnets provides a magnetic field (not shown) that repositions latching element (not shown) in an unlock position.

Figure 4:
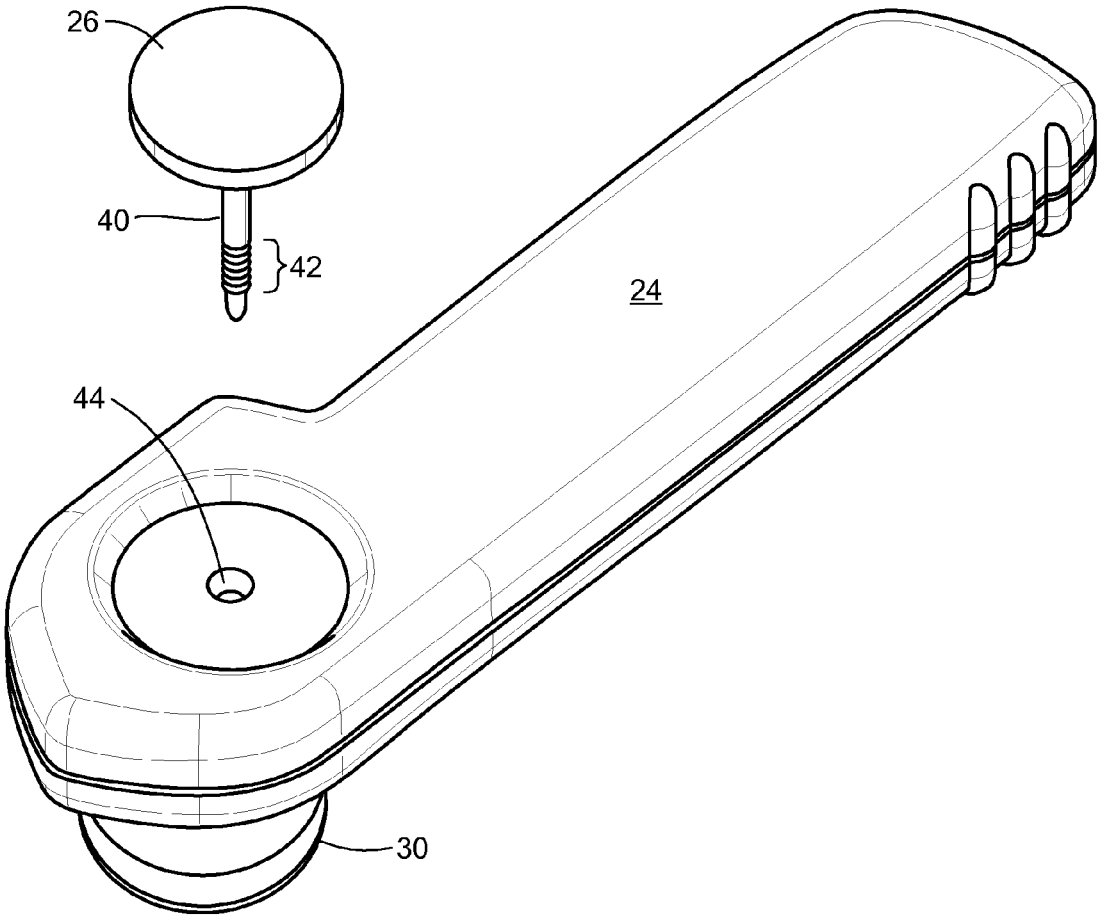
FIG. 4 illustrates a perspective view of a security tag and tack constructed in accordance with the present invention.

Referring to FIG. 4, a perspective view of security tag 24 and tack 26 is provided in accordance with the principles of the present invention. Tack 26 is removably insertable into security tag 24 via tag aperture 44. Tack 26 includes a pin 40 extending from head of tack 26 in which pin 40 has one or more grooves 42 (collectively referred to as "groove 42"). The head of tack 26 may be formed using plastic and/or steel, among other materials. For example, the head of tack 26 may be formed using plastic while pin 40 is formed with steel. Alternatively, in order to reduce the amount of magnetic material in tack 26, i.e., the magnetic effect of tack 26, non-magnetic stainless steel may be used for tack 26 such as for pin 40. Groove 42 may be one or more concentric grooves located at different portions of pin 40. Groove 42 receives a portion of latching element 52 (FIGS. 5-9) when the pin of tack 26 is inserted into tag aperture 44 such that tack 26 is substantially prevented from being removed from tag aperture 44.

Figure 5:
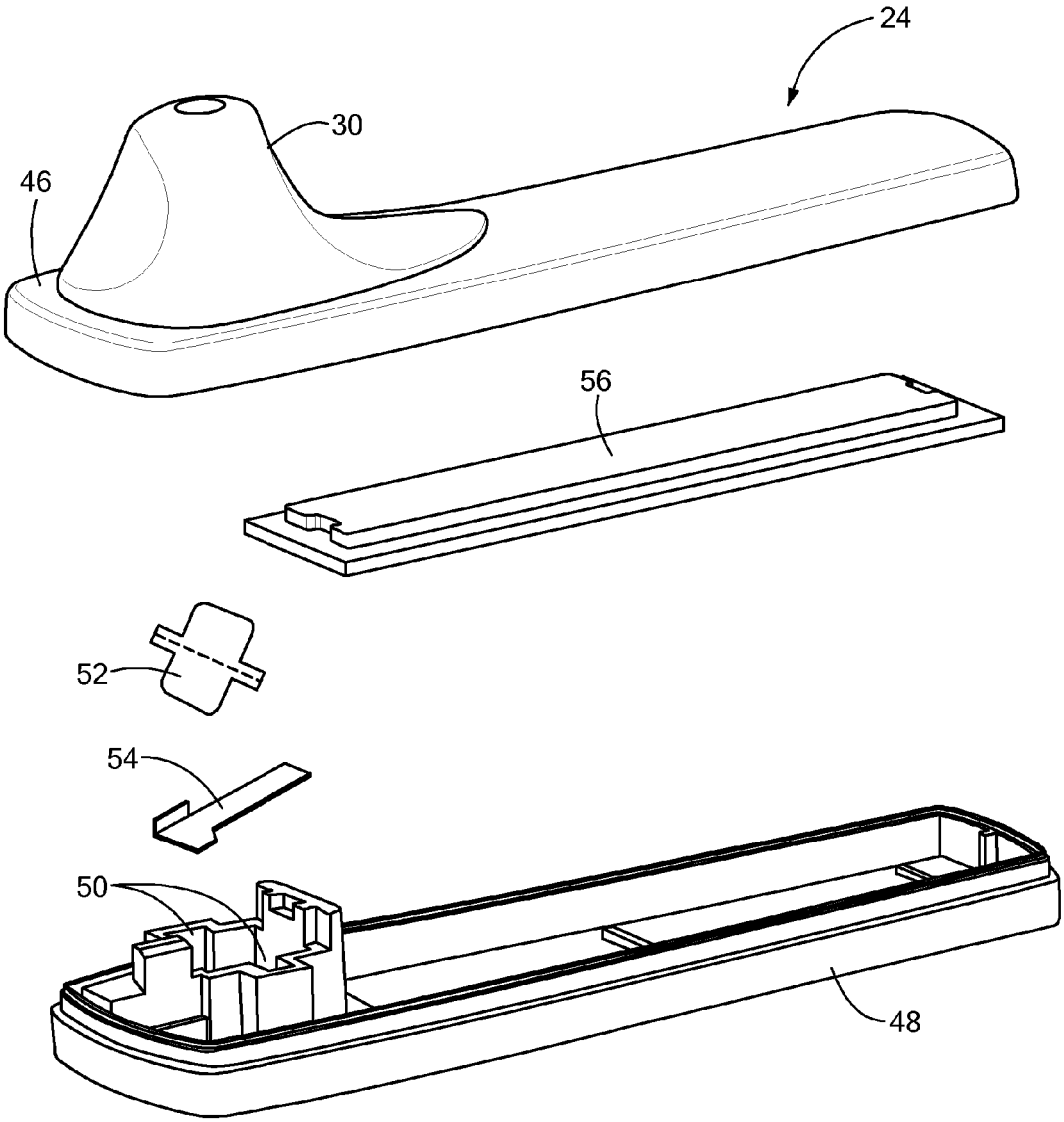
FIG. 5 illustrates an exploded view of a security tag constructed in accordance with the present invention.

FIG. 5 shows an exploded view of security tag 24. Security tag 24 includes first housing portion 46 and second housing portion 48 mateable with first housing portion 46 to form the security tag 12 housing. In particular, first housing portion 46 and second housing portion 48 may be mated together via ultrasonic welding, snap fitting and/or other mechanisms that join first housing portion 46 and second housing portion 48. First housing portion includes protrusion 30 as discussed above with respect to FIG. 3. Second housing portion 48 includes one or more recesses 50 (collective referred to as "recess 50") in which recess 50 supports latching element 52, i.e., latching element 52 is disposed within security tag 12 housing such that recess 50 supports pivot tabs 66 discussed in detail with respect to FIG. 6. Latching element 52 removably engages groove 42 of pin 40, i.e., latching element 52 is positionable in at least one of a lock position and unlock position. Latching element 52 is discussed in detail with respect to FIG. 6.

Security tag 24 further includes bias element 54 that releasably positions latching element 52 in a lock position such that latching element 52 removably engages groove 42 when pin 40 is inserted into security tag 24 via tag aperture 44. Lock and unlock positions of latching element 52 are discussed in detail with respect to FIGS. 8 and 9. Bias element 54 may be a spring such as a leaf spring and/or other biasing component that releasably positions latching element 52 in a lock position. Security tag 24 further includes EAS element 56 that generates a detectable signal when introduced to an interrogation signal, e.g., 58 kHz interrogation signal or radio frequency (RF) interrogation signal, among other interrogation signals known in the art. EAS element 56 may be a magnetic element, acousto-magnetic element, radio frequency element and/or other type of element capable of generating a detectable signal when introduced to the interrogation signal.

Figure 6:
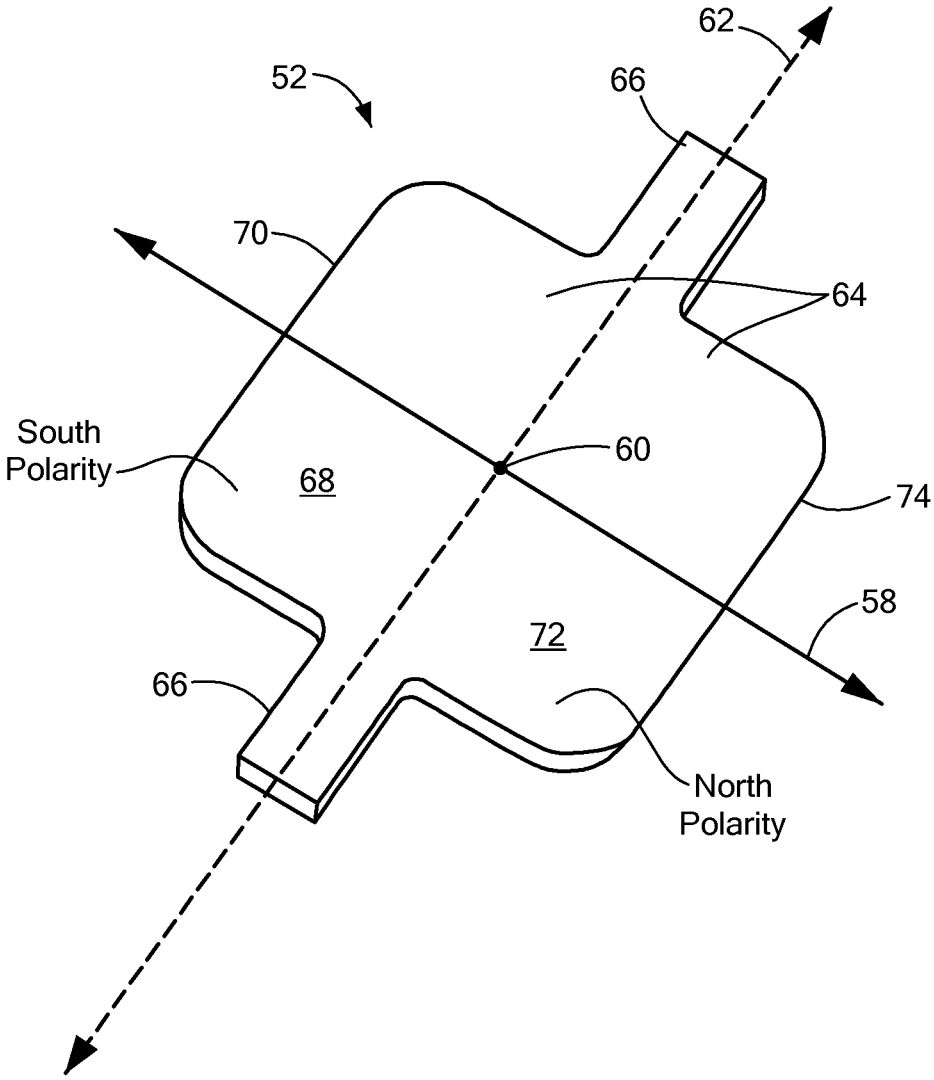
FIG. 6 illustrates a perspective view of a latching element constructed in accordance with the present invention.

A perspective view of latching element 52 provided in accordance with the principles of the present invention is described with reference to FIG. 6. Latching element 52 includes longitudinal axis 58, longitudinal center 60 and lateral pivot axis 62. In one embodiment latching element 52 is substantially symmetrical about lateral pivot axis 62 and/or longitudinal axis 58. Lateral pivot axis 62 is disposed through or substantially near longitudinal center 60 in which longitudinal center 60 is disposed through or substantially near the center of gravity of latching element 52 or planar portion 64, i.e., longitudinal center 60 may be disposed through the center of gravity of latching element 52 or planar portion 64. Lateral pivot axis 62 may also be disposed through the center of gravity of latching element 52 or planar portion 64 in which the longitudinal axis 58 is orthogonal to lateral pivot axis 62. For example, lateral pivot axis 62 and the center of gravity of latching element 52 or planar portion 64 are within a distance of approximately twenty percent of the length of the latching element 52 from each other, i.e., latching element 52 may be unbalanced by up to substantially twenty percent. Latching element 52 may be asymmetrical or substantially symmetrical (embodiment shown in FIG. 6) about lateral pivot axis 62 and/or longitudinal axis 58 such that latching element has a substantially balanced rotational response about lateral pivot axis 62 when exposed to an external physical mechanical impulse, i.e., external mechanical force such as banging the security tag 24 on a table. As used herein, a substantially balanced rotational response is understood to include an unbalanced rotational response of up to substantially twenty percent.

Latching element 52 further includes planar portion 64 and one or more pivot tabs 66 (collectively referred to as "pivot tab 66") extending from planar portion 64 along lateral pivot axis 62 and being rotatable about lateral pivot axis 62. In particular, the location of pivot tab 66 establishes lateral pivot axis 62 of latching element 52. Planar portion 64 may be asymmetric or substantially symmetric about lateral pivot axis 62. While pivot tab 66 is shown being substantially rectangular or rectangular prism shaped, other pivot tab 66 shapes may be used that allow rotational movement of pivot tab 66 while inserted within recess 50. Moreover, one or more pivots tabs 66 may be similar in shape and/or different in shape depending on design need.

While planar portion 64 is shown having a substantially square profile, other symmetrical or asymmetrical shapes may be used in accordance with the principles of the invention such as an asymmetrically shaped planar portion 64 having a center of gravity located at or substantially near lateral pivot axis 62. Planar portion 64 includes first portion 68 having a first end 70 and second portion 72 having a second end 74 in which first portion 68 and second portion 70 are rotatable about lateral pivot axis, 62, i.e., first end 70 and second end 74 are rotatable about lateral pivot axis 62. In particular, first portion 68 is substantially symmetric to second portion 72 such that the center of gravity of latching element 52 or planar portion 64 is located at or substantially near lateral pivot axis 62. In one embodiment, first portion 68 may be asymmetric second portion 72 in which the center of gravity of latching element 52 and/or planar portion 64 is located at or substantially near the pivot axis 62 such that latching element 52 and/or planar portion 64 has a balanced rotational response about pivot axis 62 when subjected to an external physical mechanical impulse. In other words, the rotational response of first portion 68 is arranged to substantially equal the magnitude of the rotational response of second portion 72 when the external impulse applied to tag 24. For example, when an external mechanical force or impulse is applied to tag 24, the rotational response of first portion 68 and second portion 72 substantially cancel each other as the two rotational responses are substantially equal but directed in opposite rotational directions. In contrast, when latching element 52 is exposed to magnetic field 76 (FIGS. 8 and 9), the magneto-mechanical rotational response of first portion 68 adds to the rotational response of the second portion 72 as the two rotational responses are in the same rotational direction. One of first end 70 and/or second end 74 removably engages groove 42 when pin 40 is inserted in security tag 24. One or both of first end 70 and second end 74 may be tapered to facilitate engagement of the tapered first or second end into groove 42. The shape of the one or more tapered ends or edges of planar portion 64 may vary based on design need.

Figure 8:
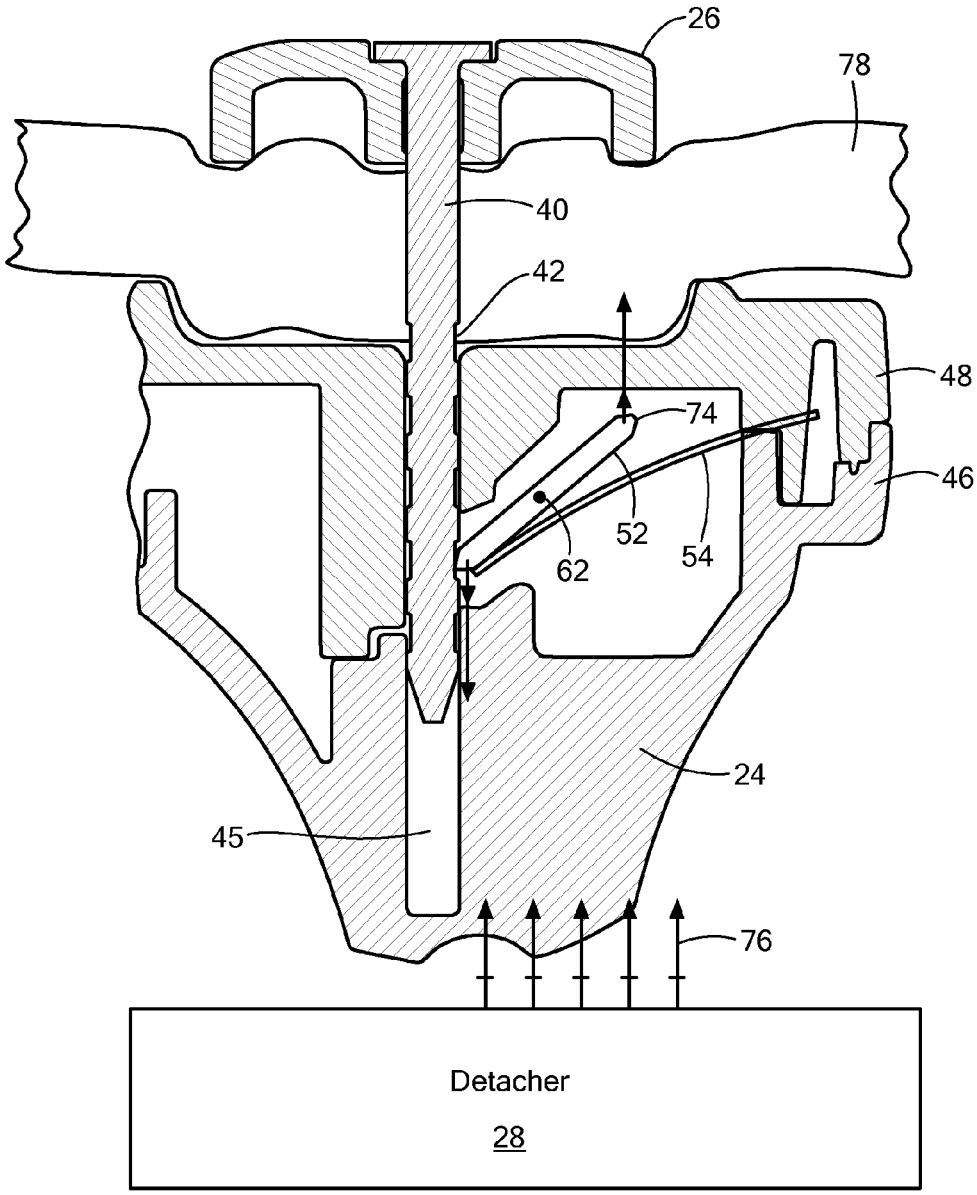
FIG. 8 illustrates a cross-sectional view of part of the security tag of FIG. 7 in a lock position and tack constructed in accordance with the present invention.
Figure 9:
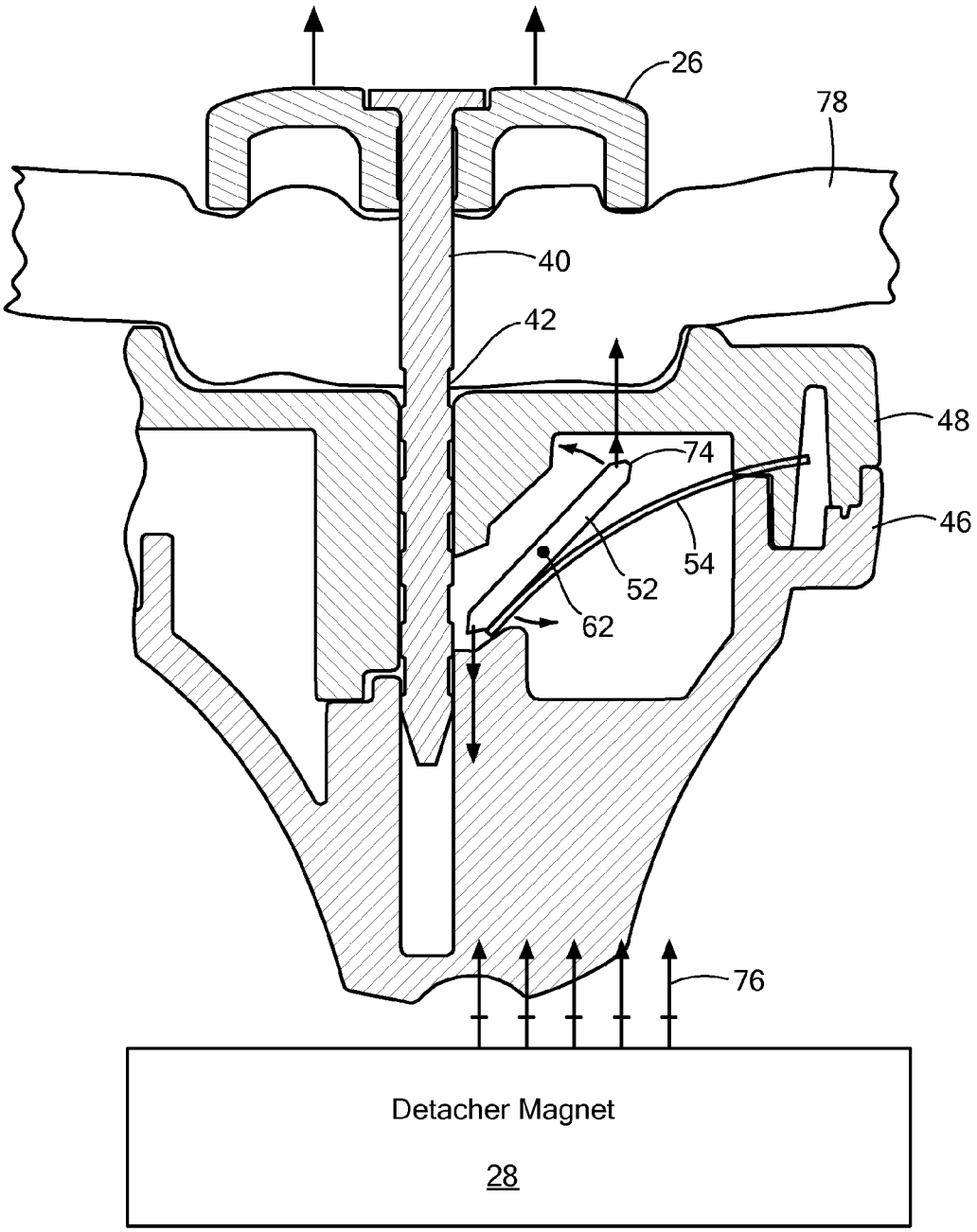
FIG. 9 illustrates a cross-sectional view of part of the security tag of FIG. 8 in an unlock position and tack constructed in accordance with the present invention.

Latching element 52 may be composed of one or more magnetic materials such that first portion 68 and corresponding first end 70 has a different magnetic response than second portion 72 and corresponding second end 74 when latching element 52 is exposed to magnetic field 76 (FIGS. 8 and 9). For example, first portion 68 may be magnetized to have a south polarity while second portion 72 is magnetized to have a north polarity such that one of portion 44 or 48 will be attracted to magnetic element 38 while the other portion will be repelled by magnetic element 38. Alternatively, first portion 68 may be magnetized to have a north polarity while second portion 72 is magnetized to have a south polarity. In other words, latching element 52 provides the advantage of making tag 24 less susceptible to external forces and also provides the additional advantage of making the unlocking or repositioning of latching element 52, i.e., disengaging latching element, more efficient by utilizing dual magnetic responses of latching element 52.

While latching element 52 is shown as being substantially symmetrical about lateral pivot axis 62, at least a portion of latching element 52 may be asymmetric about lateral pivot axis 62. In another embodiment, latching element 52 may have one or more apertures such that the mass of latching element 52 is reduced, e.g., one or more apertures located at or near the center of the latching element. Reducing the mass of latching element 52 advantageously reduces the rotational inertia of latching element 52 and lowers the required bias force by bias element 54 needed to position latching element in the lock position when subjected to an external mechanical impulse.

Figure 7:
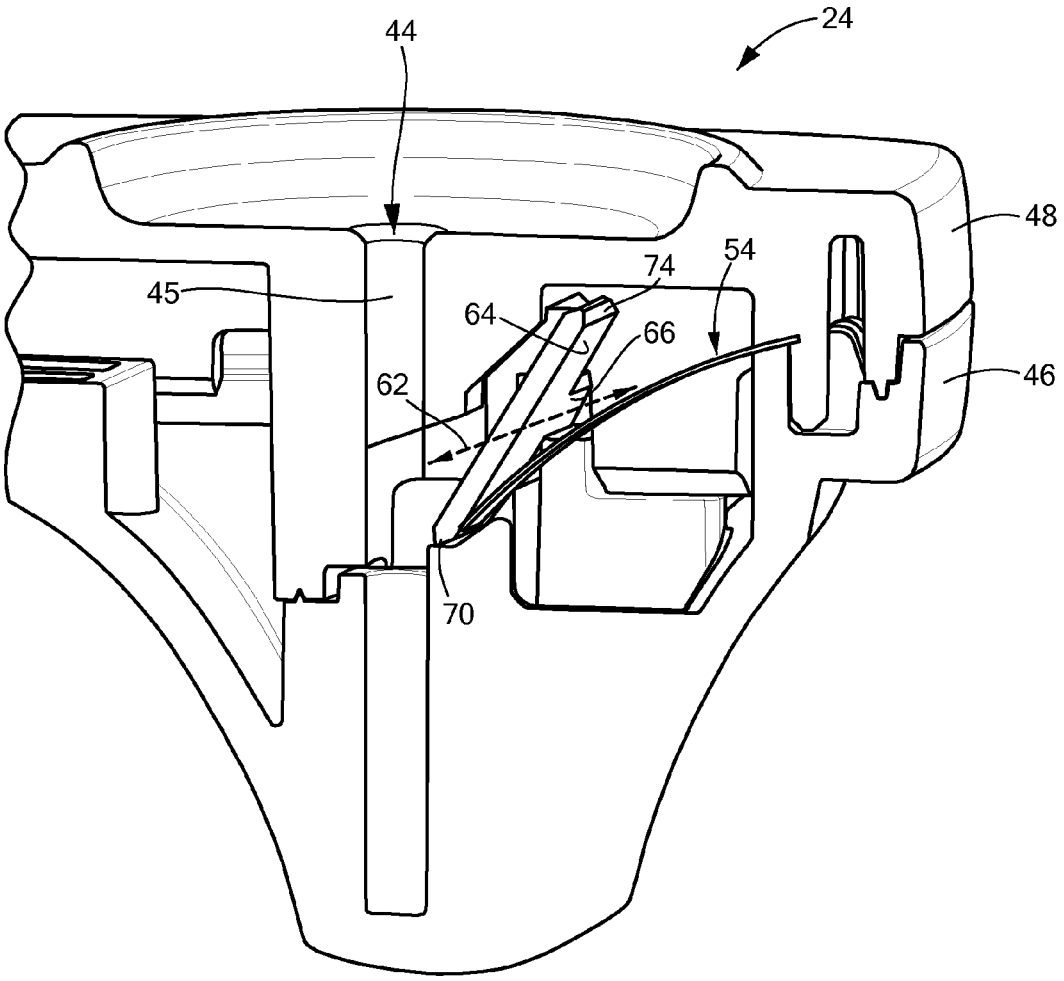
FIG. 7 illustrates a cross-sectional view of part of a security tag constructed in accordance with the present invention.

Referring to FIG. 7, a cross-sectional view of a portion of security tag 24 having bias element 54 and latching element 52 in an unlock position is described. As used herein, the unlock position corresponds to latching element 52 being disengaged from pin 40 or groove 42. In particular, pivot tab 66 of latching element 52 is retainably inserted into recess 50 that allows pivot tab 66 to rotate about lateral pivot axis 62. In particular, moment of first portion 68 in a first direction causes the same magnitude of moment in second portion 72 but in a direction opposite the first direction. Bias element 54 provides a bias force to first portion 68 of latching element 52 to releasably position latching element 52 in a lock position. When a magnetic field is applied to latching element 52, the resulting rotational force exceeds the bias force such that first portion 68 moves away from pin channel 45.

Positioning latching element 52 such that the center of gravity of latching element 52 or planar portion 64 is positioned at or substantially near lateral pivot axis 62 helps minimize the rotational response from an external mechanical force or impulse. In particular, pivot axis 62 and center of gravity of latching element 52 are within a distance of up to approximately twenty percent of a length of latching element 52 from each other so that latching element 52 is considered substantially balanced. Applying an external mechanical force, shock, acceleration or deceleration to latching element 52 by hitting or shaking security tag 24 creates a first rotational response on first portion 68 and second rotational response on second portion 72, in which latching element 52 is designed such that the first and second rotational responses counteract each other in order to minimize the net rotational response of latching element 52. By minimizing the net rotational response of latching element 52, bias element 54 is able to help keep latching element 52 substantially in the locked position, i.e., latching element 40 remains removably engaged to groove 42 of inserted pin 40, even in the presence of external physical mechanical forces or physical mechanical impulses. In other words, latching element 52 or planar portion 64 having a center of gravity at or substantially near lateral pivot axis 62 helps negate the effects of external mechanical forces applied to latching element 52, i.e., reduces the effects of mechanical forces caused by banging or shaking security tag 24.

Referring to FIG. 8, a cross-section view of a portion of system 22 with latching element 52 in the lock position is described. Latching element 52 is biased by bias element 54 in a locked position such that first end 70 is removably engaged to groove 42 in order to substantially inhibit removal of tack 26 from security tag 24, i.e., security tag 24 remains removably attached to article 78. When security tag 24 is positioned near detacher 28, i.e., protrusion 30 is removably inserted into receiving aperture 34 of detacher 28, magnetic field 76 induces a magneto-mechanical response from latching element 52. In particular, first portion 68 has a first magnetic response when exposed to magnetic field 76 and second portion 72 has a second magnetic response when exposed to magnetic field 76. The first magnetic response is opposite the second magnetic response such that the first portion 68 is attracted to detacher 28 while the second portion 72 is repelled by detacher 28. In other words, both the first portion 68 and second portion 72 contribute to the resulting rotational response of latching element 52. Alternatively, first portion 68 can be magnetized to be repelled by detacher 28 while second portion 72 is magnetized to be attracted to detacher 28, by placing detacher 28 directly on top of tack 26 in which detacher 28 grips or attracts tack 26 for removal while providing a magnetic field to reposition latching element 52.

Referring to FIG. 9, a cross-section view of a portion of tag 24 with latching element 52 in the unlock position is described. In particular, latching element 52 has rotated to the unlock position due at least in part to magnetic field 76. For example, the resulting rotational response of latching element 52, i.e., due in part to the first and second magnetic responses of first and second portions 68 and 72, exceeds the bias force being applied to latching element 52 by bias element 54. Bias element 54 is being pushed away from pin 40 or groove 42 by the magneto-mechanical response of latching element 52 such that latching element disengages from pin 40, i.e., first portion 68 or first end 70 disengages from groove 42.

While latching element 52 is disengaged from pin 40, tack 26 may be removed from security tag 24, thereby detaching security tag 24 from article 78. Bias element 54 repositions latching element back in the lock position once security tag 24 is no longer proximate detacher 28 or once the bias force provided by bias element 54 exceeds the resulting rotational response of latching element 52.

Figure 10:
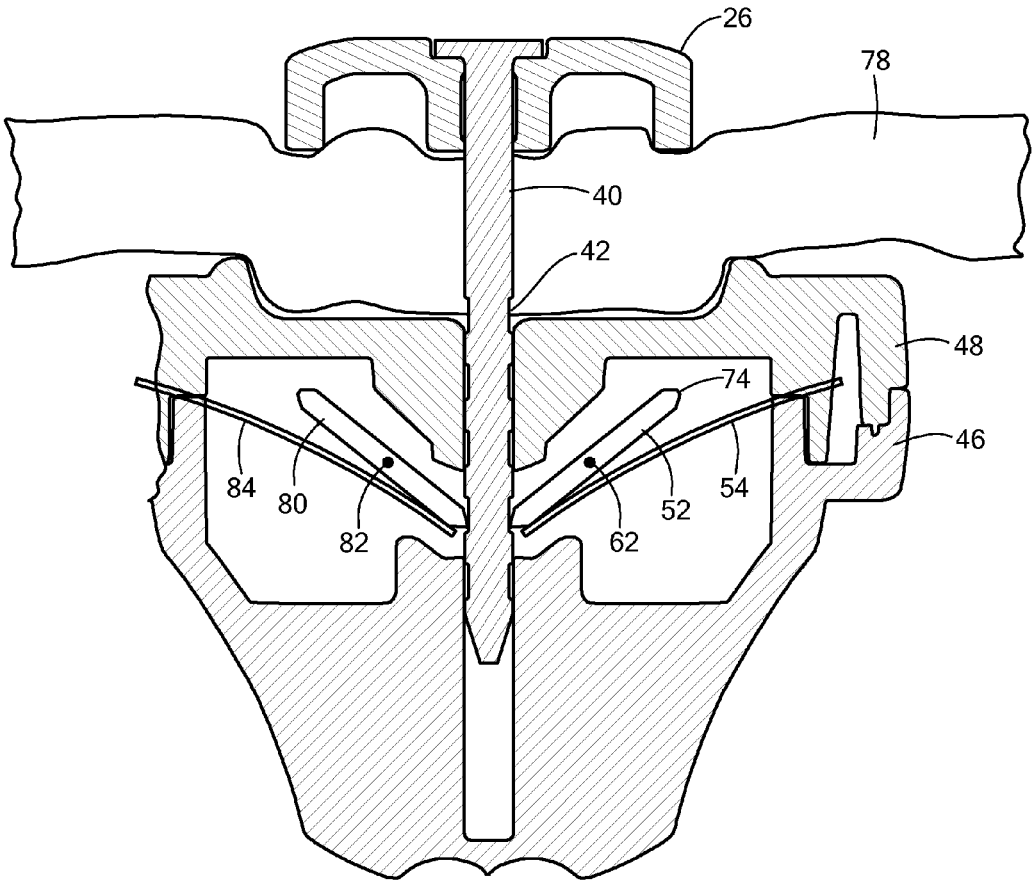
FIG. 10 illustrates a cross-sectional view of another embodiment of the security tag and tack constructed in accordance with the present invention.

Referring to FIG. 10, a cross-sectional view of a portion of an alternative embodiment of system 22 with dual latching elements is described. In particular, security tag 24 includes similar components with substantially similar functions as security tag 24, described with reference to FIGS. 7-9, with the exception that security tag 24 includes second latching element 80 and second bias element 84. Second latching element 80 is releasably positioned in a second lock position by second bias element 84 to engage groove 42. In particular, second latching element 80 pivots about second lateral pivot axis 82 is disposed through or substantially near the center of gravity of second latching element 80 in which lateral pivot axis 82 and the center of gravity of second latching element 80 are within a distance of up to approximately twenty percent of a length of latching element 80 from each other, i.e., second latching element 80 is considered substantially balanced. Second latching element 80 has substantially the same structure and composition as latching element 52 such that detacher 28 repositions both latching elements 52 and 80, i.e., latching element 80 has a longitudinal center, longitudinal axis, lateral pivot axis orthogonal to the longitudinal axis and a plurality of pivot tabs extending from the lateral pivot axis.

Latching element 80 may be re-positioned or released to a second unlock position when exposed to magnetic field 76 similar to latching element 52. In particular, first and second portions of latching element 80 may have different magnetic response similar to latching element 52 such that the resulting rotational result of latching element 80 exceeds the bias force being provided by second bias element 84. While second latching element 80 is illustrated being opposite latching element 52, one of ordinary skill in the art will recognize that the second latching element may be positioned in another location within security tag 24 that allows both latching element 52 and second latching element 80 to engage one or more grooves 42 associated with pin 40. Further, latching element 52 and/or second latching element 80 may be unbalanced by greater than twenty percent since an impact of the physical mechanical impulse is attenuated by the separate latches located at multiple positions/locations within security tag 24. While latching element 52 and second latching element 80 are shown engaged to groove 42 at the same level or height, latching element 52 may engage a different level groove 42 than second latching element 80. In one embodiment, the separate latches may be substantially orthogonal to each other i.e., substantially forming a right angle when viewed from the top or bottom. Also, it is contemplated that more than two latching elements and bias elements may be incorporated within security tag 24.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. A security tag, comprising:

a housing;

a latching element disposed within the housing and positionable in a lock position and in an unlock position, the latching element including a pivot axis, the latching element having a substantially balanced rotational response about the pivot axis when exposed to an external physical mechanical impulse; and a bias element, the bias element releasably positioning the latching element in the lock position.

2. The security tag of claim 1, wherein the latching element is substantially symmetric about the pivot axis.

3. The security tag of claim 1, wherein the latching element has a magneto-mechanical rotational response when exposed to a magnetic field, the magneto-mechanical response includes pivoting of the latching element about the pivot axis to position the latching element in the unlock position.

4. The security tag of claim 3, further comprising a pin, the pin being removably insertable into the housing, one of the first end and second end being:

releasably engaged to the inserted pin when the latching element is in the lock position; and disengaged from the inserted pin when the latching element is exposed to the magnetic field.

5. The security tag of claim 4, further comprising:

a second latching element disposed within the housing and positionable in a second lock position and in a second unlock position, the second latching element including a second pivot axis, the second latching element having a substantially balanced rotational response about the second pivot axis when exposed to the external physical mechanical impulse; and a second bias element, the second bias element releasably positioning the second latching element in the second lock position, the second latching element being releasably engaged to the inserted pin when the second latching element is in the second lock position.

6. The security tag of claim 3, wherein the latching element further includes:

a first end; and a second end distal the first end, the first end having a similar magneto-mechanical rotational response as the second end when the latching element is exposed to the magnetic field.

7. The security tag of claim 3, wherein the latching element further includes:

a first end; and a second end distal the first end, the first end having one of a north polarity and south polarity, the second end having a polarity opposite the polarity of the first end.

8. The security tag of claim 1, further comprising a pin, the pin being removably insertable into the housing;

the latching element being:

releasably engaged to the inserted pin when the latching element is in the lock position; and disengaged from the inserted pin when the latching element is in the unlock position, the latching element being positioned in the unlock position when the latching element is exposed to a magnetic field.

9. The security tag of claim 1, wherein the latching element further includes a center of gravity, the pivot axis and the center of gravity of the latching element being within a distance of up to substantially twenty percent of a length of the latching element from each other.

10. The security tag of claim 1, further comprising an electronic article surveillance (EAS) element disposed within the housing, the EAS element emitting a detectable response when exposed to an EAS interrogation signal, the EAS element being one of a magnetic element, acousto-magnetic element and radio frequency element.

11. A security system, comprising:

a security tag, the security tag device including:

a housing;

a pin, the pin being removably insertable into the housing;

a latching element being disposed within the housing and positionable in a lock position and in an unlock position, the latching element including a pivot axis, the latching element having a substantially balanced rotational response about the pivot axis when exposed to an external physical mechanical impulse; and a bias element, the bias element releasably positioning the latching element in the lock position, the latching element releasably engaging the inserted pin when in the lock position.

12. The security system of claim 11, further comprising a magnetic detacher, the magnetic detacher configured to apply a magnetic field to the security tag; and the latching element having a magneto-mechanical response when exposed to the magnetic field, the magneto-mechanical response positioning the latching element in the unlock position by disengaging the latching element from the pin.

13. The security system of claim 11, wherein the latching element further includes:

a first end; and a second end distal the first end, the first end having one of a north polarity and south polarity, the second end having a polarity opposite the polarity of the first portion.

14. The security system of claim 11, wherein the security tag further includes:

a second latching element being disposed within the housing and positionable in a second lock position and in a second unlock position, the second latching element including a second pivot axis, the second latching element having a substantially balanced rotational response about the second pivot axis when exposed to the physical mechanical external impulse; and a second bias element, the second bias element releasably positioning the second latching element in the second lock position, the second latching element releasably engaging the inserted pin when in the lock position.

15. The security system of claim 11, wherein the first pivot axis and a center of gravity of the latching element are within a distance of up to substantially twenty percent of a length of the latching element from each other; and the second pivot axis and a center of gravity of the second latching element are within a distance of up to approximately twenty percent of a length of the second latching element from each other.

16. The security system of claim 11, further comprising an electronic article surveillance (EAS) element, the EAS element configured to emit a detectable response when exposed to an EAS interrogation signal.

17. A latching element for use in a security tag, the latching element comprising:

a center of gravity;

a pivot axis, the pivot axis being disposed substantially near the center of gravity;

a plurality of pivot tabs disposed along the axis, the plurality of pivots tabs being rotatable about the pivot axis; and the latching element including a first end and second end distal the first end, the first end having a similar magneto-mechanical rotational response as the second end when the latching element is exposed to the magnetic field.

18. The latching element of claim 17, wherein the pivot axis being disposed substantially through the center of gravity includes the pivot axis and the center of gravity being within a distance of up to substnatially twenty percent of a length of the latching element from each other.

19. A security system, comprising:

a security tag, the security tag device including:

a housing;

a pin, the pin being removably insertable into the housing;

a first latching element being disposed within the housing and positionable in a first lock position and in a first unlock position;

a first bias element, the first bias element releasably positioning the first latching element in the first lock position, the first latching element releasably engaging the inserted pin when in the first lock position;

a second latching element disposed within the housing and positionable in a second lock position and in a second unlock position;

a second bias element, the second bias element releasably positioning the second latching element in the second lock position, the second latching element releasably engaging the inserted pin when in the second lock position; and at least one of the first latching element and second latching element are substantially balanced, a pivot axis and a center of gravity of the at least one of the first latching element and second latching element being within a distance of up to approximately twenty percent of a length of the at least one substantially balanced latching element from each other.

20. The security system of claim 19, wherein at least one of the first latching element and second latching element are unbalanced, a pivot axis and a center of gravity of the at least one of the first latching element and second latching element being a distance greater than substantially twenty percent of a length of the unbalanced at least one latching element from each other.

21. The security system of claim 20, wherein the first latching element is positioned orthogonal to the second latching element.

* * * * *